US008770407B2

(12) United States Patent
Laupie et al.

(10) Patent No.: US 8,770,407 B2
(45) Date of Patent: Jul. 8, 2014

(54) STACKABLE PACKAGE AND A PACKAGING ASSEMBLY MADE THEREWITH

(75) Inventors: Marc Laupie, Nomexy (FR); Nicolas Dabrowski, Vittel (FR)

(73) Assignee: Nestec S.A., Vevey (CH)

( * ) Notice: Subject to any disclaimer, the term of this patent is extended or adjusted under 35 U.S.C. 154(b) by 84 days.

(21) Appl. No.: 12/919,991

(22) PCT Filed: Feb. 25, 2009

(86) PCT No.: PCT/EP2009/051946

§ 371 (c)(1),
(2), (4) Date: Aug. 27, 2010

(87) PCT Pub. No.: WO2009/106472

PCT Pub. Date: Sep. 3, 2009

(65) Prior Publication Data

US 2011/0000812 A1 Jan. 6, 2011

(30) Foreign Application Priority Data

Feb. 29, 2008 (EP) ..... 08102177

(51) Int. Cl.
*B65D 21/024* (2006.01)
*B65D 21/02* (2006.01)

(52) U.S. Cl.
CPC ..... *B65D 21/023* (2013.01); *B65D 21/0202* (2013.01); *B65D 21/02* (2013.01)
USPC ..... 206/504; 206/506

(58) Field of Classification Search
CPC ... B65D 21/023; B65D 21/0202; B65D 21/02
USPC ..... 206/503, 509, 506, 504, 507, 508, 589, 206/515; 220/23.83, 23.6, 23.4, 23.2
See application file for complete search history.

(56) References Cited

U.S. PATENT DOCUMENTS 3,214,052 A 10/1965 Dike
3,369,688 A 2/1968 Dike (Continued)

FOREIGN PATENT DOCUMENTS

DE 31 07 716 9/1982
DE 3107716 A * 9/1982

(Continued)

OTHER PUBLICATIONS

International Search Report PCT/EP2009/051946—date of mailing May 13, 2009, 4 pages.

*Primary Examiner* — Fenn Mathew
*Assistant Examiner* — Kevin Castillo
(74) *Attorney, Agent, or Firm* — K&L Gates LLP

(57) ABSTRACT

The present invention concerns a flexible or semi-flexible stackable package (1) for flowable products, comprising a package body (2) with side (3), top (4) and bottom (5) walls, and a neck (6) adapted to receive closing and/or dispensing means (15) that extends outwardly from one of said walls (3, 4, 5) characterized in that: (i) said neck (6) is off-centered and tilted relative to the vertical axis (V) of said package (1) with an angle ($\alpha$) comprised between 1° and 179°, preferably comprised between 20° and 60°, more preferably an angle of 45°, and (ii) the package body walls (3, 4, 5) comprise at least one flattened, rounded, or recessed portion (7), such that when stacked in a package assembly (10), the neck (6) of said package (1) fits in between a space (8) defined by similar packages disposed adjacent to said neck (6).

7 Claims, 8 Drawing Sheets

(56) References Cited

U.S. PATENT DOCUMENTS

| | | | | |
|---|---|---|---|---|
| 4,037,722 | A * | 7/1977 | Bremer | 206/523 |
| 4,308,955 | A * | 1/1982 | Schieser et al. | 206/509 |
| 4,640,423 | A * | 2/1987 | Mednis | 215/10 |
| 4,805,793 | A | 2/1989 | Brandt et al. | |
| 4,984,713 | A * | 1/1991 | Chambers et al. | 222/105 |
| 5,779,051 | A * | 7/1998 | Boutin | 206/504 |
| 6,591,986 | B2 * | 7/2003 | Soehnlen et al. | 206/434 |
| 7,467,714 | B2 * | 12/2008 | Slat et al. | 206/509 |
| 2003/0070951 | A1 * | 4/2003 | Hurley et al. | 206/427 |
| 2004/0256397 | A1 * | 12/2004 | Nakazato et al. | 220/628 |

FOREIGN PATENT DOCUMENTS

| | | |
|---|---|---|
| DE | 35 00 674 | 8/1985 |
| DE | 89 09 327 | 3/1990 |
| FR | 1 483 961 | 6/1967 |
| GB | 887 893 | 1/1962 |
| NL | 6 707 947 | 12/1967 |
| WO | 2007/112598 | 10/2007 |

* cited by examiner

STACKABLE PACKAGE AND A PACKAGING ASSEMBLY MADE THEREWITH

FIELD OF THE INVENTION

The present invention concerns stackable packages that, when grouped in a pallet, increase the pallet stability and maximize the volume filling in the pallet. Advantageously, the said invention concerns flexible or semi-flexible packages.

BACKGROUND OF THE INVENTION

In palettisation systems like other packing and packaging areas, it is more and more important to restrict the amount of packaging material used for cost and environmental reasons, or at least use recyclable materials and systems. For these reasons, and due to the reduction of packaging material, the packages become flexible, or at least partially flexible. When such flexible or semi-flexible packages are grouped and stacked into a pallet, issues arise concerning the pallet stability, especially during handling and transportation, that is to say when the pallet is moved and is subject to external mechanical forces and constraints. In order to enhance the overall mechanical resistance of the pallet constituted of flexible or semi-flexible packages, the headspace of such packages is generally filled with gas, which can be air, or more generally a neutral gas such as nitrogen ($N_2$). Such a gas is filled at a higher pressure than the atmospheric pressure, so that the flexibility of the package is reduced or cancelled. Filling the headspace however requires an additional equipment in the manufacturing lines, which adds complexity and costs to the process, and is therefore clearly disadvantageous.

In the palettisation systems, it is however important to improve the stability of the pallets so that, while the size of a pallet is kept unchanged and the amount of packaging material that is used is decreased, the overall mechanical properties of the pallet are improved. If possible, it is crucial for a constant volume of the pallet, to increase the volume of individual packages constitutive of the said pallet.

Different systems have been developed which involve stretching films for wrapping the pallet once it is constituted, or similar systems. However, such over wrapping film solutions require a specific equipment to wrap the pallet with film, and also require quite a large amount of packaging material, or even several materials.

Moreover, it was found that during transportation or handling of the pallets, a high pressure is applied onto the pallet which is directed in the transversal direction. It is therefore a major issue to also reinforce the pallets to lateral/transversal forces, on top of the high top load resistance a pallet must have.

U.S. Pat. No. 4,805,793 granted to Brandt et Al. and published Feb. 21, 1989, discloses a stackable bottle which comprises a recess in its bottom portion, such that when two bottles are stacked one above the other, the neck and top handle if any of the lower bottle, fit into the recess of the upper bottle, so as to maximize volume filling on the pallet. Such a configuration also allows to increase the top load resistance of the pallet, because vertical forces applied to each bottle in the pallet stand on a larger surface, i.e. on the shoulders of said bottle, instead of standing on the closure and neck of the same. The bottles disclosed in this document are however reinforced, for example with ribs and grooves in their walls, and the latter comprise a high thickness along with the high top load resistance requirement. Such bottles, while allowing a good resistance in one direction of the pallet (vertical), still do not show sufficient resistance to mechanical constraints applied in other directions to the pallet. What is more, such bottles do not solve at all the problem of saving packaging material for ecological and economical reasons, while keeping same or even improving their overall mechanical resistance.

WO 2007/112598 A1 is an international patent application to Dean Lane, published Oct. 11, 2007. It discloses a stackable ribbed bottle system, similar to the packaging system disclosed in U.S. Pat. No. 4,805,793. Similarly, WO '598 packages do not show sufficient resistance to mechanical constraints applied to the pallet in other directions than vertical. Also similarly to the drawbacks in US '793, the bottles disclosed in WO '598 do not solve at all the problem of saving packaging material for ecological and economical reasons, while keeping same or even improving their overall mechanical resistance.

It is therefore a main purpose of the present invention to provide stackable bottles that participate to improving the overall pallet stability when palletized, and especially the top lad and transversal load resistance, while being economic to produce and easy to handle, stack and transport.

Finally, it is a further objective of the present invention to provide flexible stackable packages which are structured so that they can be stacked in various position, depending on whether they need to be stacked, stored, transported, or during dispensing.

SUMMARY OF THE INVENTION

The above listed purpose and needs are met by the present invention with a flexible or semi-flexible stackable package for flowable products, comprising a package body with side, top and bottom walls, and a neck adapted to receive closing and/or dispensing means that extends outwardly from one of said walls.

According to the present invention, the stackable package is characterized in that:

(i) said neck is off-centred and tilted relative to the vertical axis V of said package with an angle $\alpha$ comprised between 1° and 179°, preferably comprised between 20° and 60°, more preferably an angle of 45°, and (ii) the package body walls comprise at least one flattened, rounded, or recessed portion, such that when stacked in a package assembly, the neck of said package fits in between a space defined by similar packages disposed adjacent to said neck.

With such a construction, each package in a stack lies on the lower package in the stack in such a way that the load constituted by the upper package is held by the liquid contained into the lower package and the walls of the latter, rather than the neck portion of the said lower package. This allows to increase dramatically the top-load resistance of the packages in a stack, up to outstanding values.

Furthermore, such a construction of the package allows to interlock similar packages that would be grouped in rows and stacked in layers, by somehow blocking the neck of each package in a package assembly, in between the adjacent packages in the assembly. Such an interlocking allows to not only ensure a cohesion of the packages in the vertical direction, but also in the other, and particularly in the horizontal/transversal, directions. Such an enhanced cohesion improves the overall package assembly transversal mechanical resistance.

In one preferred embodiment of the present invention, said at least one flattened, rounded or recessed portion is disposed such that when said package is stacked in a package assembly comprising at least two layers made of rows of similar packages, the neck of said package and/or the closing and/or dispensing means for said neck, rest at least partially on a portion of the side wall of at least one package disposed adjacent to said neck in the same layer of packages.

In that way, part of the top load applied on individual packages necks is transferred to the adjacent package's side walls, which allows to evenly distribute the load amongst the different packages in a layer, and also evenly distribute the force applied to one particular package across its surface. This even distribution allows to further increase the top load resistance of the whole packaging assembly.

Advantageously, the package according to the present invention is a polyethyleneterephtalate (PET) blow-molded bottle, wherein the weight of polyethyleneterephtalate (PET) for a 3 liter contents package is equal or less than 50 g, preferably less than 40 g. It could however be made of any other material suitable for being blow-moulded such as for instance HDPE (high density polyethylene), PE (polyethylene), PP (polypropylene), PLA (polylactic acid), starched-based thermoplastic polymers, or a combination thereof.

In one first embodiment, the neck of the package is closed by a dispensing tap.

In a second alternative embodiment of the present invention, the neck is closed by a screwed cap.

In a highly preferred embodiment, the thickness at least in the side walls portion of the package is lower than or equal to 200 μm, preferably lower than or equal to 100 μm.

The present invention is further directed to a packaging assembly, comprising at least two layers, each layer being constituted of a plurality of packages arranged in at least one row, each package being structured according to any of the above described features.

Preferably, the packages of two consecutive superimposed layers in the packaging assembly are disposed in a staggered arrangement.

Also preferably, the load resistance of the packaging assembly is higher than 180 kgf for a 3 L bottle made of 40 g polyethyleneterephtalate (PET) when a transversal force is applied on one side of said packaging assembly, and the top load resistance of the packaging assembly is higher than 50 kgf for a 3 L bottle made of 75 g polyethyleneterephtalate (PET) when a vertical force is applied on the top of said packaging assembly. It was surprisingly found that a standard 3 L bottle with much more PET stands much lower top load value than our invention.

Advantageously, the packaging assembly is a pallet, and even more advantageously, the packaging assembly is such that it further comprises a interlayer insert board disposed between two adjacent layers, said interlayer board comprising apertures disposed across its surface, through which the necks of the individual packages disposed in the adjacent—upper and/or lower—layer(s) are inserted.

If we compare the compactness of a pallet (i.e. the ratio of total volume of the pallet divided by the total volume occupied by the packages) comprising packages according to the present invention to a pallet made of square bottles, it is surprisingly very close, or almost identical. The additional benefit brought by packages according to the present invention is pallet stability as the packages according to the invention are more squat then a standard bottle (eg. rounded bottles used for bottling mineral water).

BRIEF DESCRIPTION OF THE DRAWINGS

Additional features and advantages of the present invention are described in, and will be apparent from, the description of the presently preferred embodiments which are set out below with reference to the drawings in which.

DETAILED DESCRIPTION OF THE INVENTION

Figure 1:
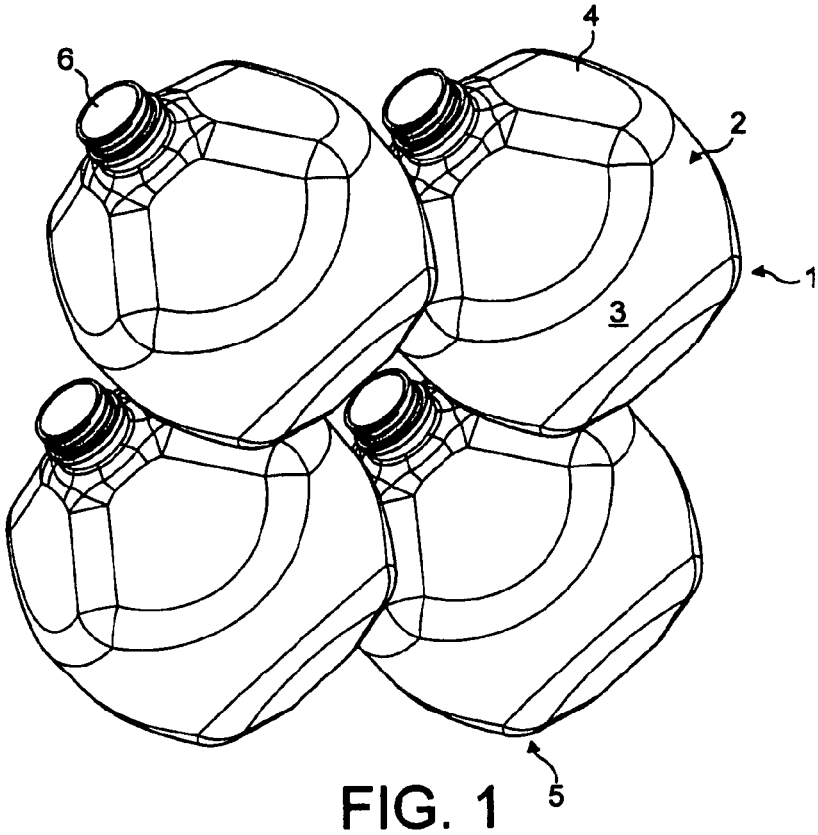
FIG. 1 is a schematic perspective view showing a plurality of stacked, unclosed, packages according to the present invention.
Figure 2:
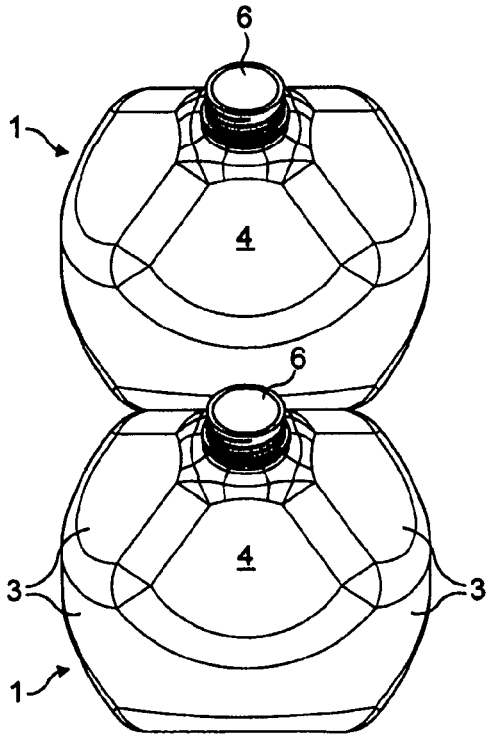
FIG. 2 is a schematic top view similar to FIG. 1.

In FIGS. 1 and 2 is illustrated a stack of semi-flexible stackable packages 1 for containing mineral water. Basically, each package according to the invention is produced by blow-moulding polyethyleneterephtalate (PET) material such that less than 15 g, preferably less than 13 g, is necessary for blowing a package having a contents volume of at least 1 liter, and wherein 40 g of polyethyleneterephtalate (PET) or less are necessary for blowing a package having a contents volume of at least 3 liters.

Each package 1 in the stack comprises a package body 2 with side 3, top 4 and bottom 5 walls, and a neck 6 adapted to receive closing and/or dispensing means that extends outwardly from said top wall 4. The package that will be described hereafter as an example with reference to the drawing, is a polyethyleneterephtalate (PET) blow-molded bottle, having a thickness in its side walls portion that is lower than or equal to 100 μm.

Figure 3:
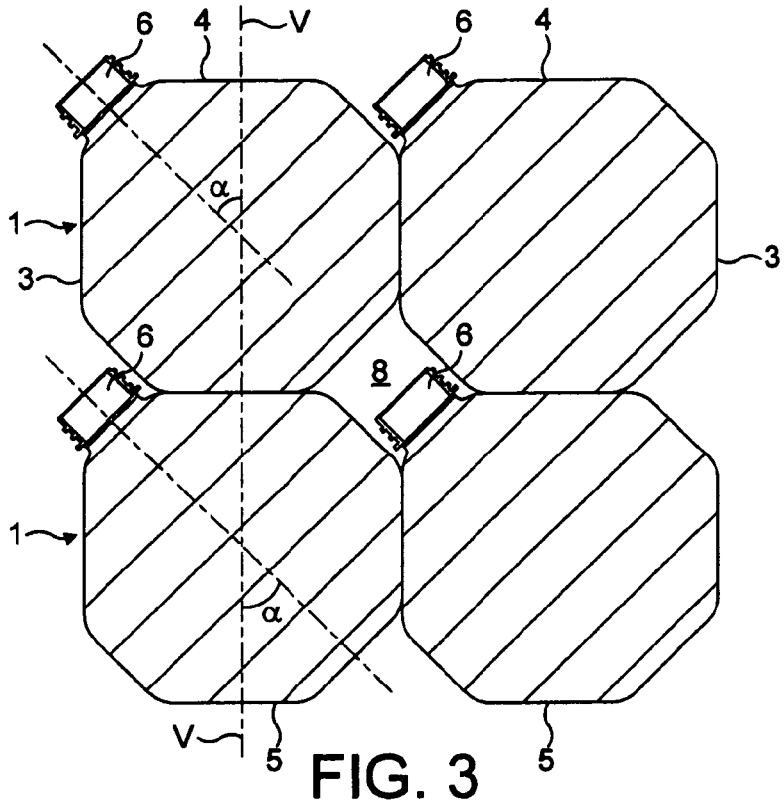
FIG. 3 is a schematic cut side view similar to FIG. 1.

As shown in FIG. 3, the neck 6 is off-centred in the top wall 4 and tilted relative to the vertical axis V of said package 1 with an angle α of about 45°.

As can be seen in FIG. 3, the package body side walls 3 a flattened portion 7 that links said side walls 3 to the bottom wall 5. As shown in FIG. 3, the profile of the package 1 is such that when several packages are positioned adjacent to one another in a stack, a space 8 is formed between the top 4 and side 3 walls of adjacent packages, wherein the neck of one package can fit. In that way, the bottom wall 5 of the packages disposed in an upper layer of the packaging stack rest on the top wall 4 of the packages disposed in a lower layer of said packaging stack, without resting on the neck of said packages disposed in the lower layer. As a consequence, the weight of the upper layer packages is transferred to the walls of the lower layer packages, and the neck portion of the latter, which is mechanically a weak point, is not subject to pressure imposed by the upper packages weight.

Figure 4:
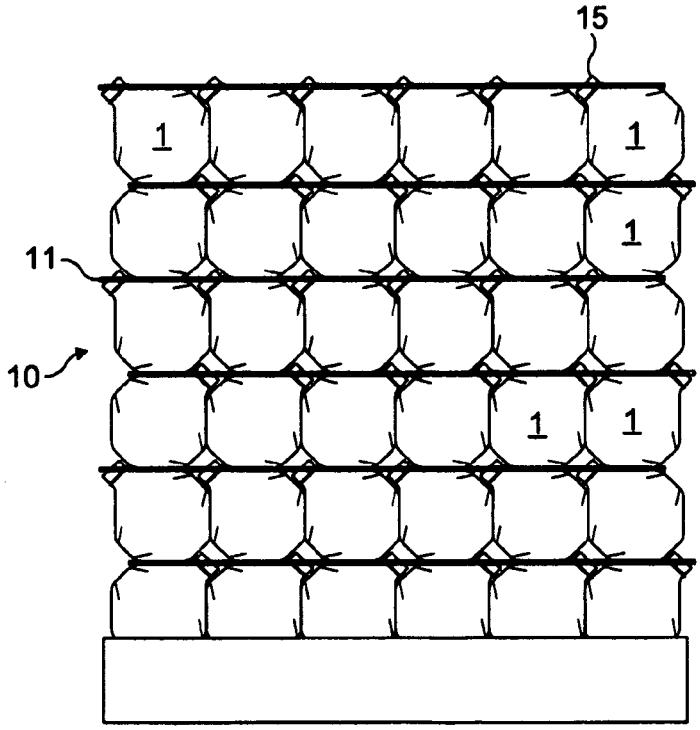
FIG. 4 is a schematic side view of a pallet whose layers are made from aligned packages according to the invention.
Figure 5:
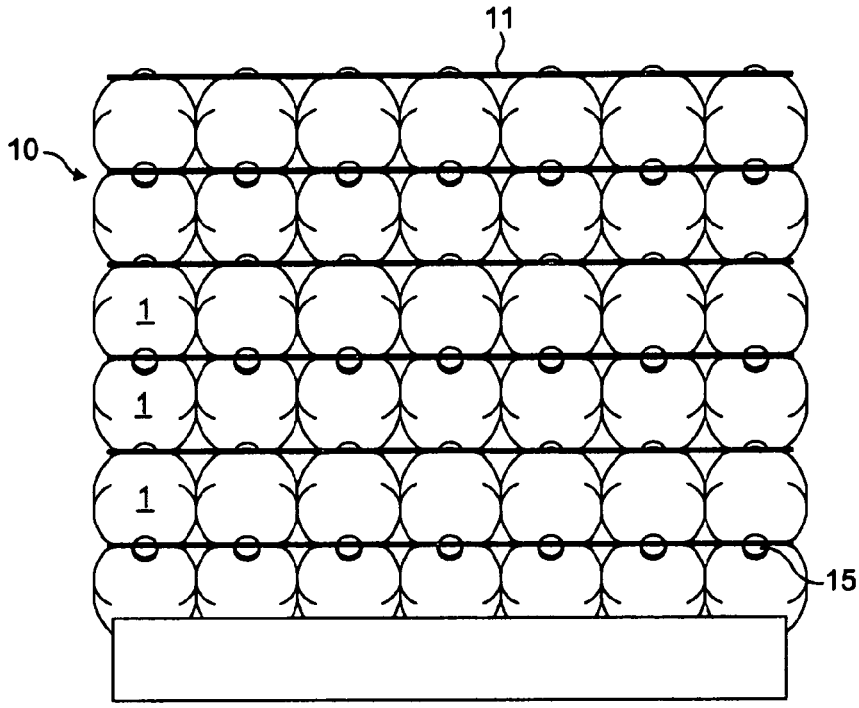
FIG. 5 is a schematic front view similar to FIG. 4.
Figure 6:
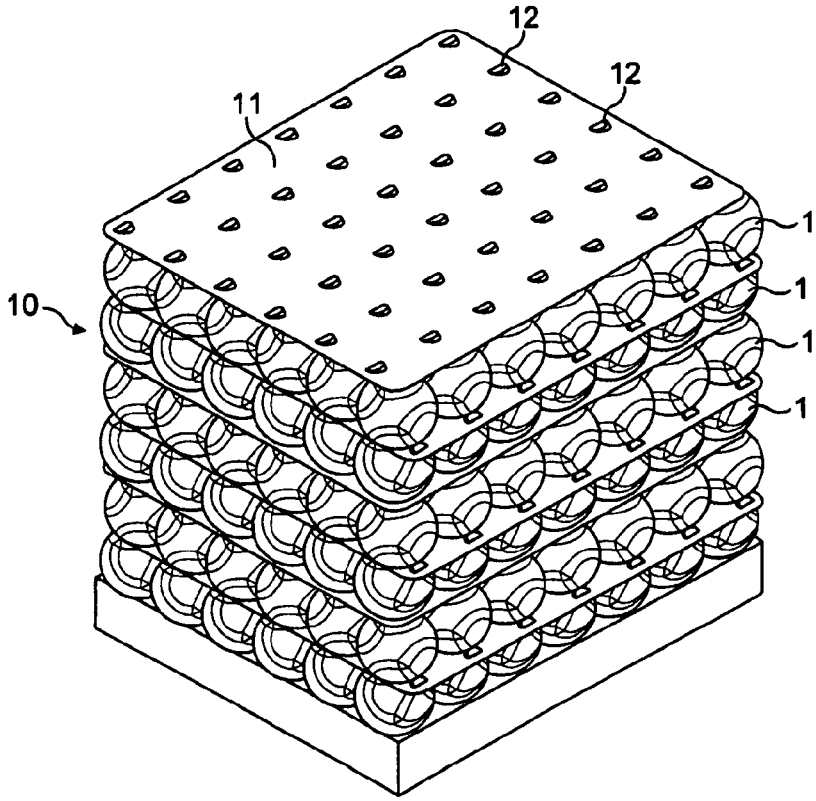
FIG. 6 is a schematic perspective view similar to FIG. 4.

FIGS. 4 and 5 illustrate how such packages 1 described above that are assembled in rows to then form stacked layers 9, to constitute a pallet 10. As can be seen further in FIG. 6, interlayer boards 11 can be inserted in between the layers 9 of the pallet 10, in order to further increase the mechanical coherence, resistance and stability of the pallet 10. Such interlayer boards 11 comprise apertures 12 disposed across the surface of the board 11 through which the necks 6 of the individual packages 1 disposed in the lower layer 9 are inserted, and so that the said necks 6 can still be disposed between adjacent packages as explained herein above.

Figure 7:
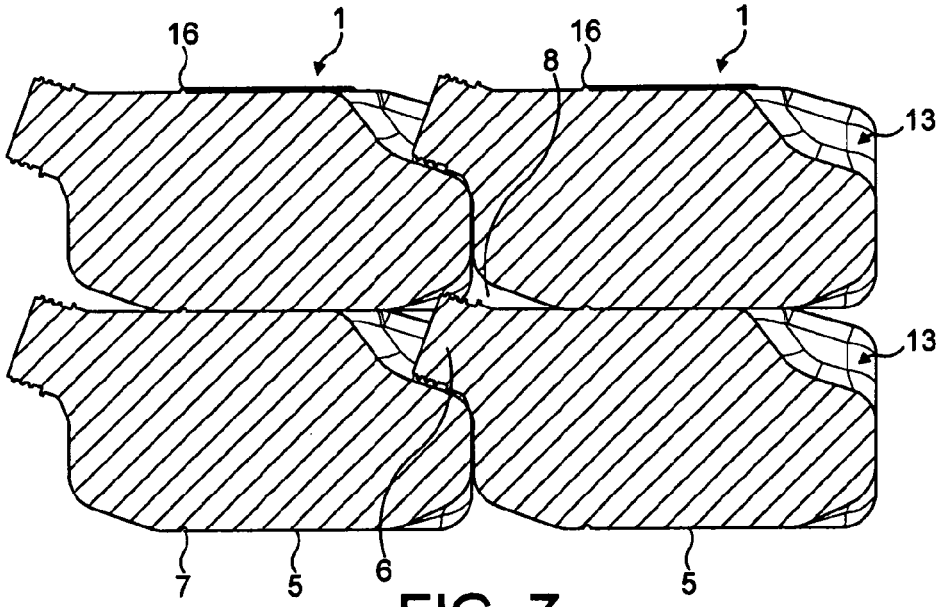
FIG. 7 is a schematic cut side view showing a second embodiment of a plurality of stacked, unclosed, packages according to the present invention.
Figure 8:
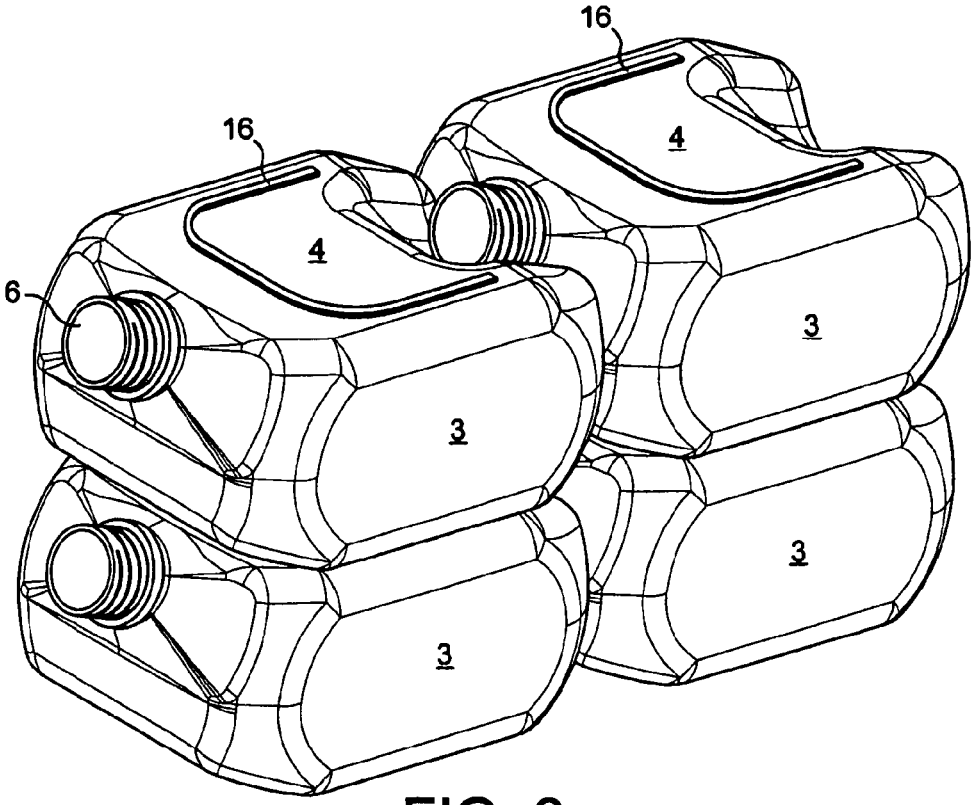
FIG. 8 is a schematic perspective view similar to FIG. 7.

In an alternative embodiment of the present invention, the packages 1 comprise a recess 13 that is disposed across the side 3 and bottom 5 walls of the package, as is illustrated in FIGS. 7 and 8.

In that way, when a package is stacked in a package assembly comprising at least two layers made of rows of similar packages, the neck 6 of said package and/or the closing and/or dispensing means that is adapted onto said neck, rest at least partially on a portion of the recess 13 disposed adjacent to said neck in the same layer 9 of packages, as shown in FIG. 7.

The space 8 defined by a recess 13 for disposing the neck 6 of one adjacent package 1 when packages are assembled—for instance in a pallet—is increased as shown in FIG. 7, by a bevelled portion 14 of the bottom wall 5 of the packages, that links the bottom wall 5 to the side walls 3 of the same package 1.

Therefore, part of the top load applied on individual packages necks 6 is transferred to the adjacent package's side walls, which allows to evenly distribute the load amongst the different packages in a layer 9, and also evenly distribute the force applied to one particular package across its surface. This even distribution allows to further increase the top load resistance of the whole packaging assembly.

Figure 9:
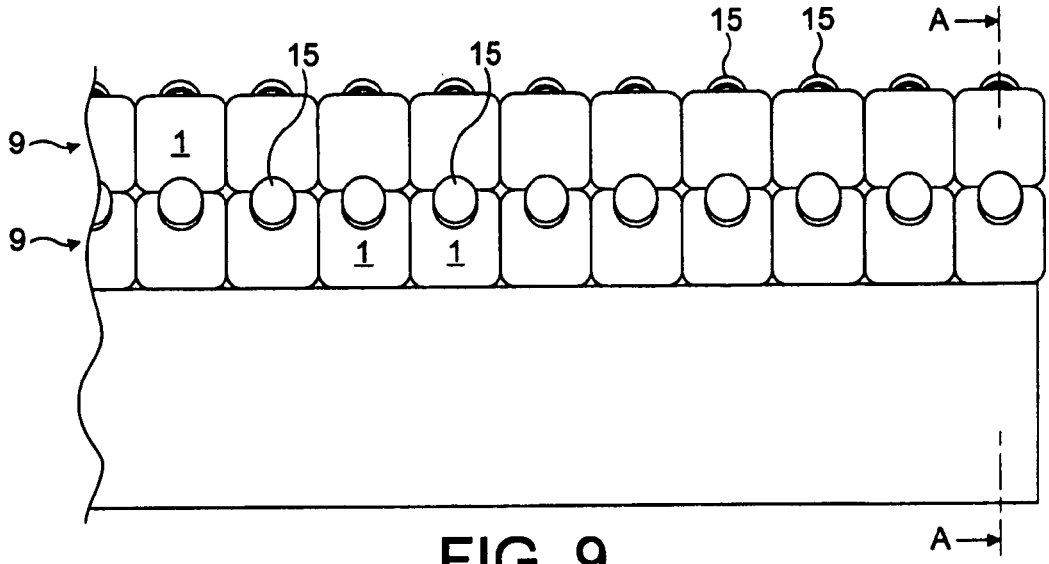
FIG. 9 is a schematic partial front view of a packaging assembly comprising two layers of packages according to the invention.
Figure 10:
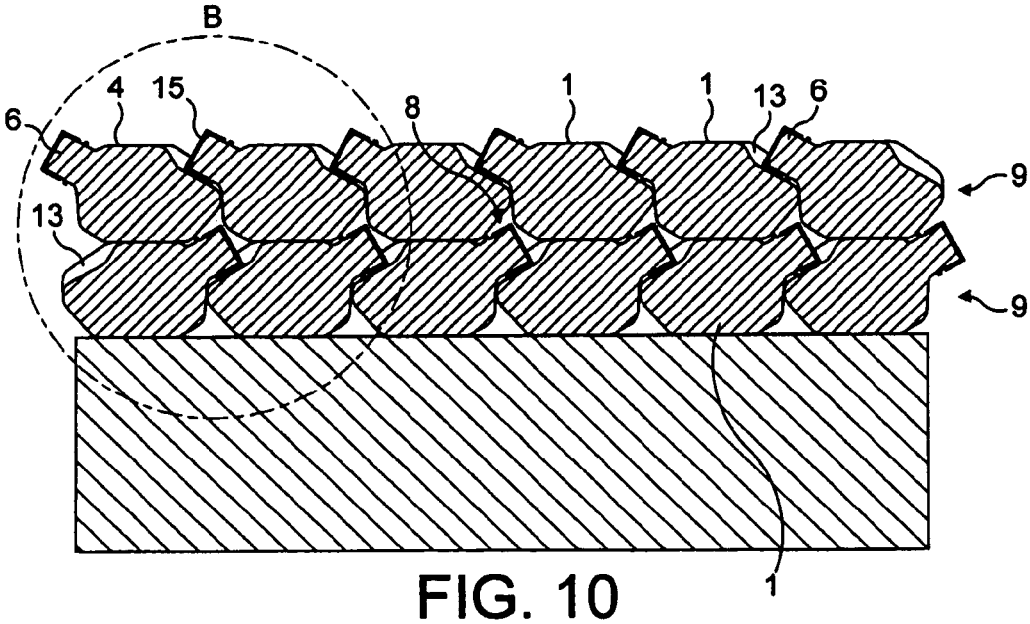
FIG. 10 is a schematic cut side view along A-A of FIG. 9.

FIGS. 9 and 10 show a packaging assembly made of two superimposed layers 9 of packages 1 according to the alternative embodiment of the invention described above.

Figure 11:
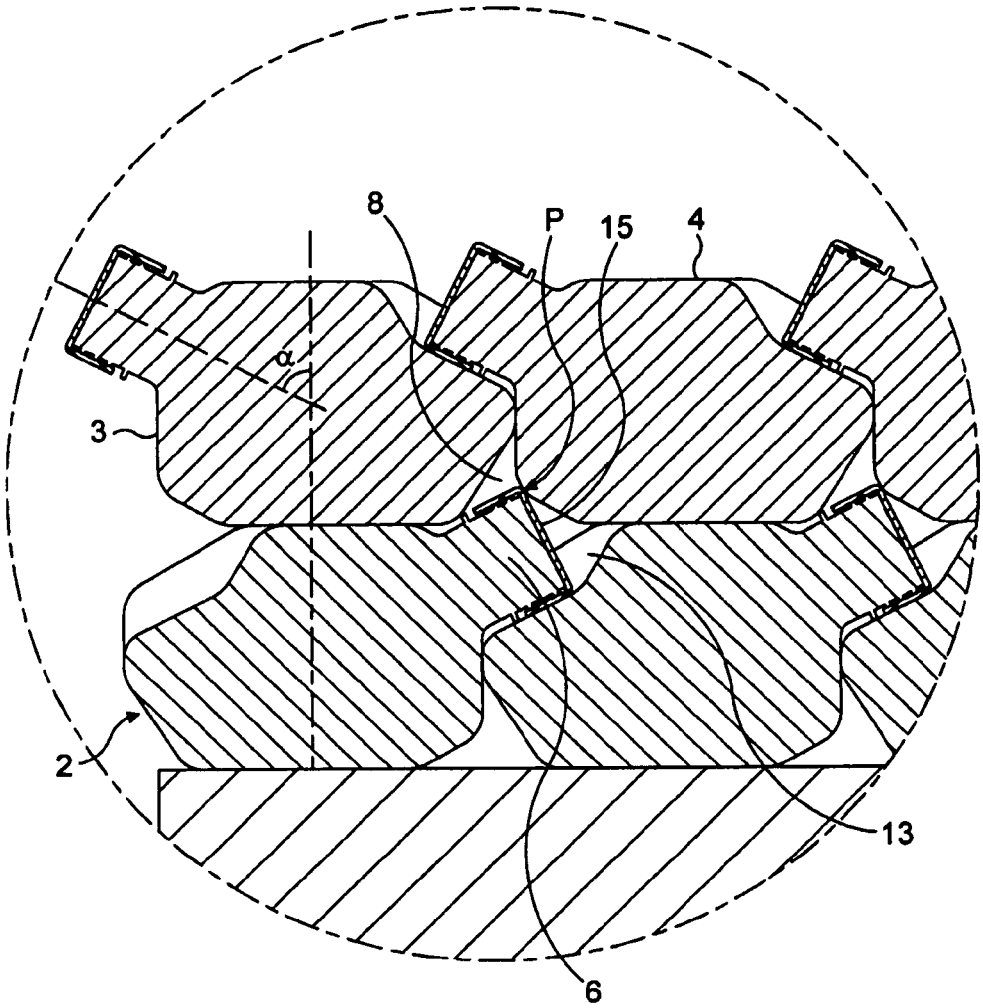
FIG. 11 is a schematic enlarged view of portion B of FIG. 10.

As can be seen in the drawing FIGS. 9 and 10, and more particularly in the enlarged view of FIG. 11, the packages 1 of the two consecutive superimposed layers 9 are disposed in a staggered configuration.

Such a staggered configuration allows to increase the self blocking arrangement of the packages in the assembly. Particularly, FIG. 11 illustrates the various points of contact of the neck and closing means 15—a screwed cap in FIG. 11—with the recess of the package adjacent in the row. Preferably, as shown in FIG. 11, the profile of the recess is such that the closure 15 closing the neck of one package, rests all along its height onto the recess of the adjacent package. This prevents that weight from an upper package in the stack damages the neck of the package in the lower layer, when there is a point of contact P between the two, as shown in FIG. 11.

The construction of a package according to the present invention allows to interlock mechanically similar packages that would be grouped in rows and stacked in layers, by blocking the neck of each package in a package assembly, in between the adjacent packages in the assembly. Such an interlocking allows to not only ensure a cohesion of the packages in the vertical direction, but also in the other, and particularly in the horizontal/transversal, directions. Such an enhanced cohesion improves the overall package assembly transversal mechanical resistance.

Figure 12:
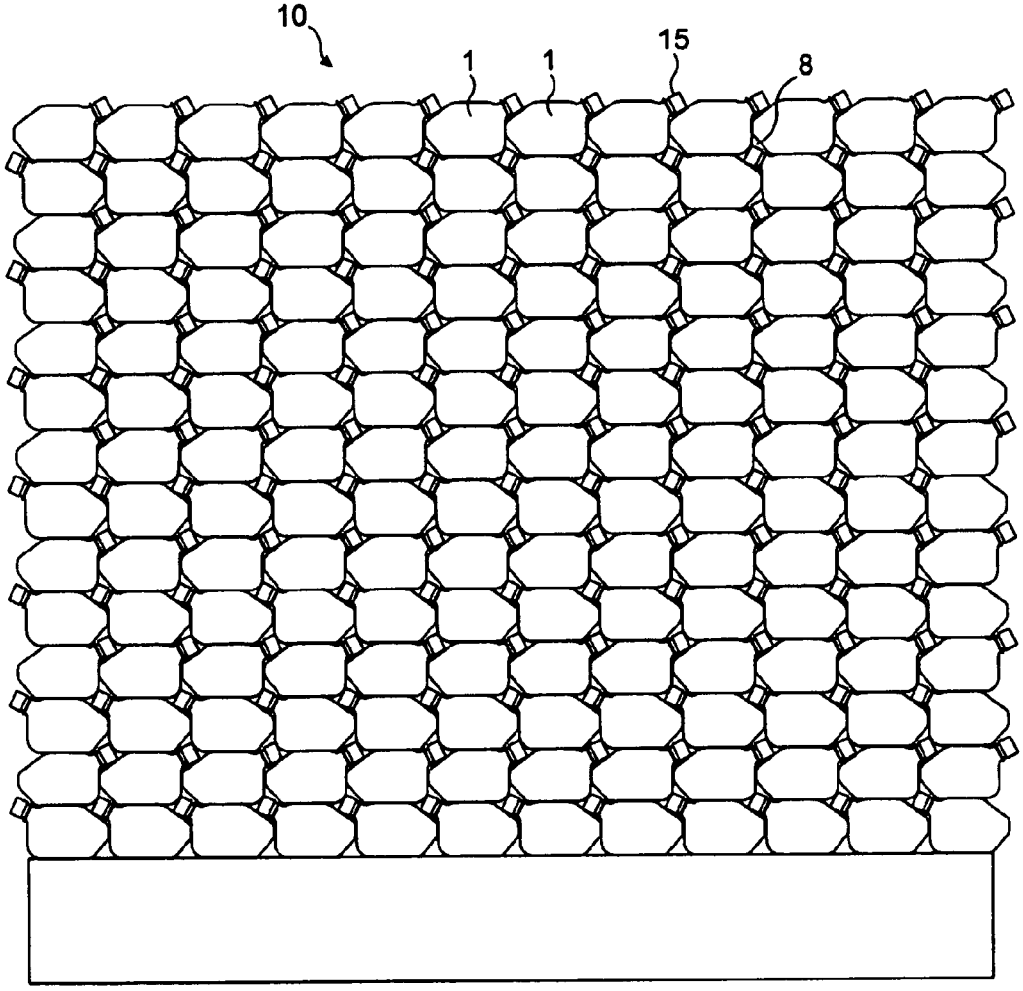
FIG. 12 is a schematic side view of a pallet whose layers are made from aligned packages according to the second possible embodiment of the invention.

FIG. 12 illustrates how packages according to the alternative embodiment of the invention described above, can be assembled in rows, then rows be stacked in a staggered arrangement to form a pallet. With such a package construction, and a pallet arrangement, it is possible to increase dramatically the mechanical resistance of the pallet as will be described hereafter. The pallet can further comprise a wrapping (not shown in the drawing), like for instance a conventional shrink film that envelops the whole pallet, once it is fully constituted.

Finally, as illustrated in FIGS. 7 and 8, the package 1 according to the invention can comprise a rib 16 disposed at the surface of its top wall, and a groove 17 of corresponding shape disposed at the surface of its bottom wall 5. Such ribs 16 and grooves 17 being such that when two packages are stacked one onto the other as shown in FIG. 7, the rib 16 of the lower package fits into the groove 17 of the upper package, in order to prevent horizontal movement of the superimposed packages, one relative to the other. As illustrated in FIG. 8, such ribs 16 and grooves 17 can have a U-shape, so that the blocking effect of the rib and groove system applies in different directions in the horizontal plan.

In any of the possible embodiments of the present invention, the load resistance of a packaging assembly made from stacked packages as described above is illustrated in the FIG. 13 for a 3 L bottle made of 40 g polyethyleneterephtalate (PET).

Figure 14:
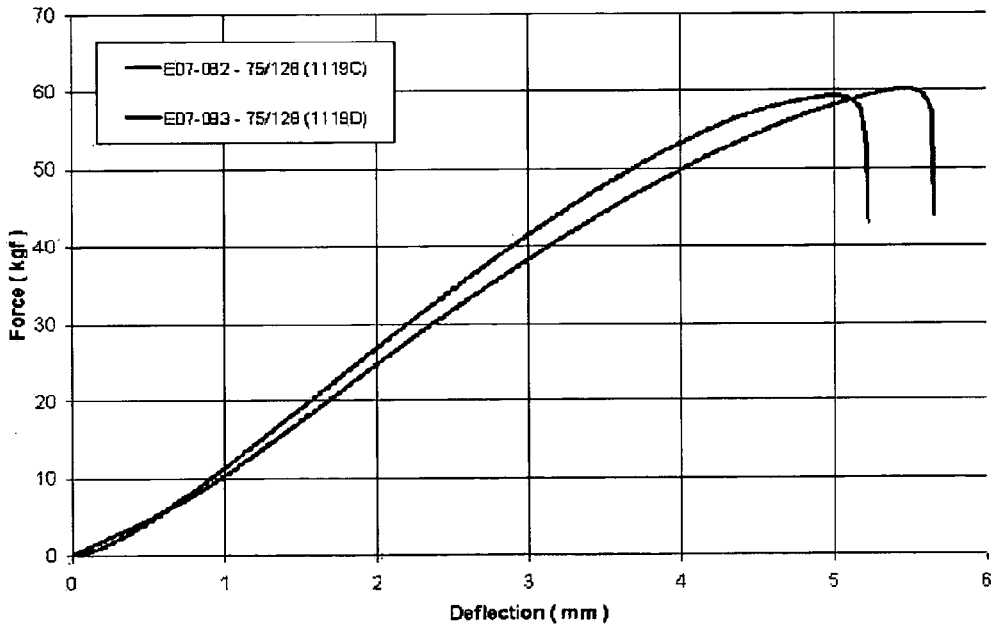

In comparison, the top load resistance of a prior art packaging assembly is illustrated in the FIG. 14, that is measured for a 3 L bottle made of 75 g polyethyleneterephtalate (prior art) when a vertical force is applied on the top of said packaging assembly.

Figure 13:
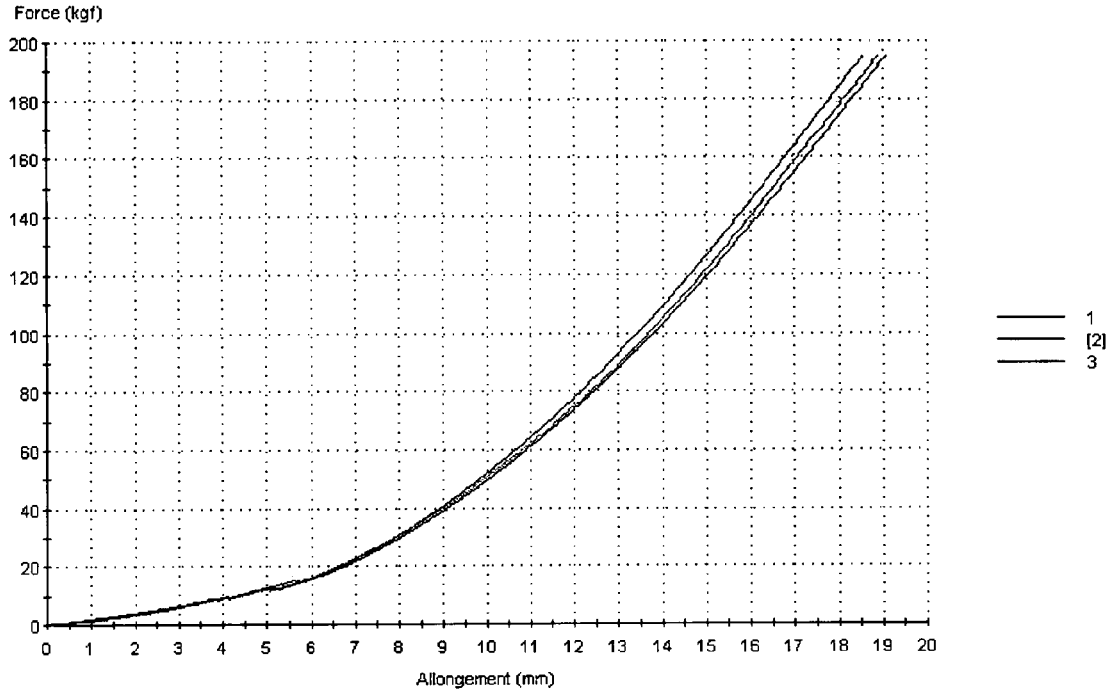
FIGS. 13 and 14 are top load resistance diagrams (pallet simulation).

In both of the FIGS. 13 and 14, each color curve corresponds to a specific sample of the same 3 L/40 g bottle for which the same measurement was performed.

Dispensing is therefore facilitated when the bottle can be placed upside-down at a angle comprised between 90° (horizontal position relative to the bottle vertical axis) and 180° (i.e. completely upside down), this angle being preferably comprised between 95° and 145°. In such a—at least partial—upside-down position, the dispensing operation of the contents is facilitated due to the flow under gravity. Such a dispensing configuration is especially useful for chilled products that have to be stored and/or dispensed in the fridge like water, or liquid food products such as for instance liquid yogurts, fruit juices, coffee or cereal beverages, or other similar types of liquid or semi-liquid products.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

The invention claimed is:

1. A flexible or semi-flexible stackable package for flowable products, comprising:

a package body with side, top and bottom walls, and a neck adapted to receive closing and/or dispensing means that extends outwardly from one of the walls;

the neck is off-centered and tilted relative to a vertical axis of the package with an angle between 20° and 60°, the vertical axis being perpendicular to the bottom wall, and the neck extending outward from the package body past the top and side walls of the package body;

the package body walls comprise at least one recessed portion such that when stacked in a package assembly, the neck of the package fits in the at least one recessed portion of a horizontally aligned package located adjacent to the neck such that the neck rests all along its height on the recessed portion of the horizontally aligned package and a package above the horizontally aligned package contacts the closure on the neck; and the top wall comprises a rib that extends outward, and the bottom wall comprises a groove having a shape corresponding to the shape of the rib.

2. The package of claim 1, wherein the at least one portion is located such that when the package is stacked in a package assembly comprising at least two layers made of rows of similar packages, the neck of the package and/or the closing and/or dispensing means for the neck rest at least partially on a portion of the side wall of at least one package located adjacent to the neck in the same layer of packages, and the rib inserts into the groove of the package directly vertical in the above layer of packages.

3. The package of claim 1, comprising a polyethyleneterephtalate blow-molded bottle, wherein the weight of polyethyleneterephtalate for a 3 liter contents package is not greater than 50 g.

4. The package of claim 1, wherein the neck is closed by a screwed cap.

5. The package of claim 1, wherein the thickness of the side walls is less than or equal to 200 μm.

6. The package of claim 1, wherein the thickness of the side walls is less than or equal to 100 μm.

7. A flexible or semi-flexible stackable package comprising:

a body having side walls, a top wall and a bottom wall and a neck;

the neck is positioned off-centered and tilted relative to a vertical axis of the package with an angle between 20° and 60°, the vertical axis being perpendicular to the bottom wall, and the neck extending outward from the package body past the top and side walls of the package body;

the package body walls comprise at least one recessed portion such that when stacked in a package assembly, the neck of the package fits in the recessed portion of a horizontally aligned package positioned adjacent to the neck such that the neck rests all along its height on the recessed portion of the horizontally aligned package and a package above the horizontally aligned package contacts the closure on the neck; and the top wall comprises a rib that extends outward, and the bottom wall comprises a groove having a shape corresponding to the shape of the rib.

* * * * *